US007308402B2

(12) United States Patent
Zhou et al.

(10) Patent No.: US 7,308,402 B2
(45) Date of Patent: Dec. 11, 2007

(54) ERROR RESISTANT SCALABLE AUDIO CODING PARTITIONED FOR DETERMINING ERRORS

(75) Inventors: Jianping Zhou, Beijing (CN); Wenwu Zhu, Basking Ridge, NJ (US)

(73) Assignee: Microsoft Corporation, Redmond, WA (US)

( * ) Notice: Subject to any disclaimer, the term of this patent is extended or adjusted under 35 U.S.C. 154(b) by 32 days.

(21) Appl. No.: 11/171,887

(22) Filed: Jun. 30, 2005

(65) Prior Publication Data

US 2005/0240403 A1 Oct. 27, 2005

Related U.S. Application Data

(63) Continuation of application No. 10/092,999, filed on Mar. 7, 2002, now Pat. No. 6,934,679.

(51) Int. Cl.
*G10L 19/14* (2006.01)

(52) U.S. Cl. ..... 704/230; 375/240.27; 382/240; 341/94

(58) Field of Classification Search ..... None
See application file for complete search history.

(56) References Cited

U.S. PATENT DOCUMENTS 5,526,353 A 6/1996 Henley et al.
5,856,973 A 1/1999 Thompson
6,031,874 A 2/2000 Chennakeshu et al.
6,101,279 A * 8/2000 Nguyen et al. ..... 382/240
6,249,319 B1 6/2001 Post (Continued)

FOREIGN PATENT DOCUMENTS

WO WO 00/54511 * 9/2000 ..... 382/240

OTHER PUBLICATIONS

Jianping Zhou, Qian Zhang, Zixiang Xiong, Wenwu Zu, "Error Resilient Scalable Audio Coding (ERSAC) for Mobile Applications," 2001 IEEE Fourth Workshop on Multimedia Signal Processing, pp. 307-312, Oct. 3, 2001-Oct. 5, 2001.*

(Continued)

*Primary Examiner*—Donald L. Storm
(74) *Attorney, Agent, or Firm*—Lee and Hayes, PLLC

(57) ABSTRACT

A scalable audio codec processes, quantizes and encodes audio signals into an embedded audio bitstream of bit-planes each having a data unit. The data unit has a beginning refinement bits partition, a second significance bits partition, a third sign boundary mark bits partition, and a fourth sign bits partition. The second and fourth partitions form a boundary for the third partition. The quantizing uses a variable length coding algorithm. The third partition is an invalid codeword for a predetermined encoding method being used to encode. The codec uses a decoder to decode the embedded audio bitstream of bit-planes using Reversible exponential Golomb (Exp-Golomb) codes in a Reversible Variable Length Code (RVLC) algorithm to produce quantized data of weighted subbands. An inverse quantizer dequantizes the quantized data into audio signals.

15 Claims, 4 Drawing Sheets

U.S. PATENT DOCUMENTS

| | | | | |
|---|---|---|---|---|
| 6,278,387 | B1 * | 8/2001 | Rayskiy | 341/61 |
| 6,339,658 | B1 * | 1/2002 | Moccagatta et al. | 382/240 |
| 6,367,049 | B1 | 4/2002 | Van Dijk et al. | |
| 6,477,277 | B1 * | 11/2002 | Chippendale et al. | 382/232 |
| 6,501,397 | B1 | 12/2002 | Radha et al. | |
| 6,580,834 | B2 | 6/2003 | Li et al. | |
| 6,757,659 | B1 | 6/2004 | Tanaka et al. | |
| 6,788,740 | B1 * | 9/2004 | van der Schaar et al. | 375/240 |
| 6,801,707 | B1 | 10/2004 | Harumoto et al. | |
| 6,934,679 | B2 | 8/2005 | Zhou et al. | |
| 2001/0022761 | A1 | 9/2001 | Sekii | |
| 2002/0021761 | A1 | 2/2002 | Zhang et al. | |
| 2003/0079222 | A1 | 4/2003 | Boykin | |

OTHER PUBLICATIONS

"A Class of Reversible Variable Length Codes for Rubust Image and Video Coding", Jiantao Wen and John D. Villasenor, 4 pages, In Proc. Int. Conf. on Imaging Processing, Santa Barbara, CA Oct. 26-29, 1997, pp. 65-68, vol. 2. IEEE, Piscataway, NJ.

* cited by examiner

ERROR RESISTANT SCALABLE AUDIO CODING PARTITIONED FOR DETERMINING ERRORS

RELATED APPLICATIONS

This application is a continuation of and claims the benefit of priority to U.S. patent application Ser. No. 10/092,999, filed Mar. 7, 2002, which issued Aug. 23, 2005 as U.S. Pat. No. 6,934,679, the disclosure of which is incorporated by reference herein.

BACKGROUND OF THE INVENTION

With the advent of the Internet age, streaming high-fidelity audio has become a reality. It is thus natural to extend audio streaming to wireless communications so that mobile users can listen to music from handheld devices. With the emerging of 2.5G (GPRS) and the third generation (3G) (CDMA2000 and WCDMA) wireless technology, streaming high-fidelity audio over wireless channels and networks has also become a reality. Internet Protocol (IP) based architecture is promising to provide the opportunity for next-generation wireless services such as voice, high-speed data, Internet access, audio and video streaming on an all IP networks. However, delivering or streaming high-fidelity audio across wireless IP networks still remains challenging due to a limited varying bandwidth. Scalable audio coding (SAC) can efficiently accommodate the varying bandwidth of wireless IP channels and networks. A scalable audio bitstream typically consists of a base layer plus a number of enhancement layers. It is possible to use only a subset of the layers to decode the audio with lower sampling resolution and/or quality. In streaming applications, several layers in a scalable audio bitstream are selectively delivered to adapt to network bandwidth fluctuation and packet loss level. For example, when the available bandwidth is low or the packet loss ratio is high, only the base layer is transmitted.

Delivering or streaming high-fidelity audio over wireless IP channels and networks is also challenging because the wireless IP channels and networks present not only packet erasures errors caused by large-scale path loss and fading, but also random bit errors due to the wireless connection. These bit errors have an adverse effect on decompressing the received audio bitstream and can cause the decoder to be come inoperative (e.g. the decoder will crash). To combat these bit errors, forward error correction (FEC) can be used to protect the compressed data. However, no matter how carefully the compressed data are protected before transmission, the received data may still have bit errors.

Considering the limited bandwidth in wireless IP channels and networks, efficient compression techniques can be applied to audio signals but there will be a lessening in sensitivity to transmission errors. To cope with bit errors on wireless IP channels and networks, conventional error resilience (ER) techniques can be used. Error resilience techniques at the source coding level can detect and locate errors, support resynchronization, and prevent the loss of entire data units. With ER techniques, audio quality can be obtained at a bit error rate of about $10^{-5}$. The bit error rate in the wireless channel, however, can be significantly higher.

Conventional ER techniques for video coding cannot be directly ported to audio coding because the characteristics of audio and video are different. In video coding there exists a strong correlation between adjacent video frames and this correlation can be exploited to recover data that is corrupted in transmission. In contrast, there is almost no correlation between adjacent audio frames in the time domain. Moreover, audio coding artifacts caused by corrupted frames are esthetically undesirable to human auditory sensibilities.

In the scalable audio codec, the audio signal is first split into individual time segments, which are filtered by a polyphase quadrature filter (PQF) and down-sampled into four subbands to facilitate scalability in sampling resolution. A modified DCT (MDCT) is then performed on each subband and the resulting MDCT coefficients are weighted by a psychoacoustic mask function. Finally, each weighted subband is encoded into an embedded audio bitstream using bit-plane coding, where each bit plane is coded into one layer or data unit (DU). FIG. 1 illustrates the syntax of a conventional scalable audio bitstream for one (1) data unit (DU) of one (1) coded bit-plane. The DU seen in FIG. 1 is formed by a process where each weighted subband of audio data is encoded into an embedded bitstream using bit-plane coding. Each bit plane is coded into one (1) layer or DU. FIG. 1 demonstrates that each DU in the audio bitstream includes strings of significance bit and strings of sign bits. All of the strings of the significance and sign bits precede a string of refinement bits in the DU. The DU can be byte-aligned by the addition of dummy zeros to the end thereof as seen in FIG. 1. In a scalable audio codec, the decoder can quantize the DU in each bit-plane in the embedded audio bitstream to produce quantized data of weighted subbands. The decoder can then dequantize the quantized data of weighted subbands into audio signals.

None of the sign bits or the refinement bits in the DU are entropy coded. As such, bit errors among the sign and refinement bits will not propagate. In contrast, the significance bits are compressed with variable length codes (VLC). When an error occurs in the portion of the DU that includes the coded significance bits and the coded sign bits, the error will propagate to each of the coded significance bits, the coded sign bits, and the coded refinement bits. The multiplexing of the DUs makes the situation more complex because when the decoder detects an error, the decoder can not identify the exact location of the error. As a result, the whole DU must be discarded, regardless of where the error occurs. Thus, it would be an advance in the art to overcome to develop an ER audio coding technique to reduce error propagation, to reduce error propagation in a DU, and to reduce the discarding of DUs. Consequently, there is a need for improved methods, apparatuses, computer programs, data structures, and systems that can provide such a capability.

BRIEF SUMMARY OF THE INVENTION

An error resilient scalable audio coding (ERSAC) scheme is proposed for mobile applications in an end-to-end streaming architecture for the delivery or streaming of audio bitstreams over wireless IP channels and networks. Error-resilience and bitstream scalability can be effectively enhanced by ERSAC in the delivery or streaming of high-fidelity audio over wireless IP channels and networks. ERSAC can be accomplished using an encoding algorithm that encodes streaming audio data while performing data partitioning and reversible variable length coding (RVLC) in a scalable audio bitstream so as to achieve error resilience, reduce packet erasures errors, and reduce random bit errors. The data partitioning is applied to limit error propagation between different data partitions in a data unit (DU), while RVLC is used as an error robustness scheme to locate errors and minimize the propagation thereof.

An inventive method encodes streaming data into data units with an encoding algorithm. Each data unit includes a coded significance bits partition between a coded refinement bits partition and a sign boundary mark (SBM) bits partition. The SBM bits partition contains a string of sign boundary mark bits that is not used in the encoding algorithm to encode streaming audio data.

DETAILED DESCRIPTION OF THE PREFERRED EMBODIMENTS

Figure 2:
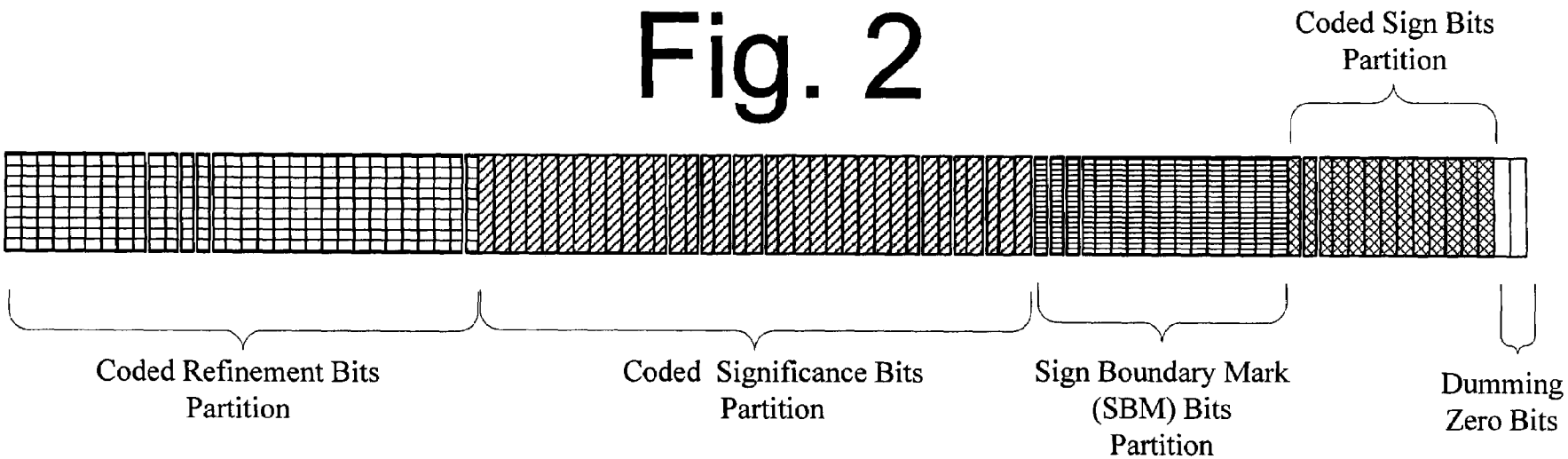
FIG. 2 is an overview, in accordance with an embodiment of the present invention, for explaining an inventive scalable audio bitstream for one (1) data unit (DU) of one (1) coded bit-plane in any of a variety of information mediums, such as a recordable/reproducible compact disc (CD).

A coder of a codec can be used to perform data partitioning of data structures. The syntax of such a data structure, in accordance with an embodiment of the present invention, is seen in FIG. 2. FIG. 2 depicts a scalable audio bitstream for one (1) data unit (DU) of one (1) coded bit-plane. As seen in FIG. 2, several independent partitions are identified in the DU, including a first partition of a string of coded refinement bits, a second partition of a string of coded significance bits, a third partition of a string of Sign Boundary Mark (SBM) bits, and a fourth partition of a string of coded sign bits. The length of the string of SBM bits is sixteen bits (e.g. two bytes). Preferably, the string of SBM bits will have a length of two or three bytes, which is relatively small compared to the length of the entire DU.

Figure 1:
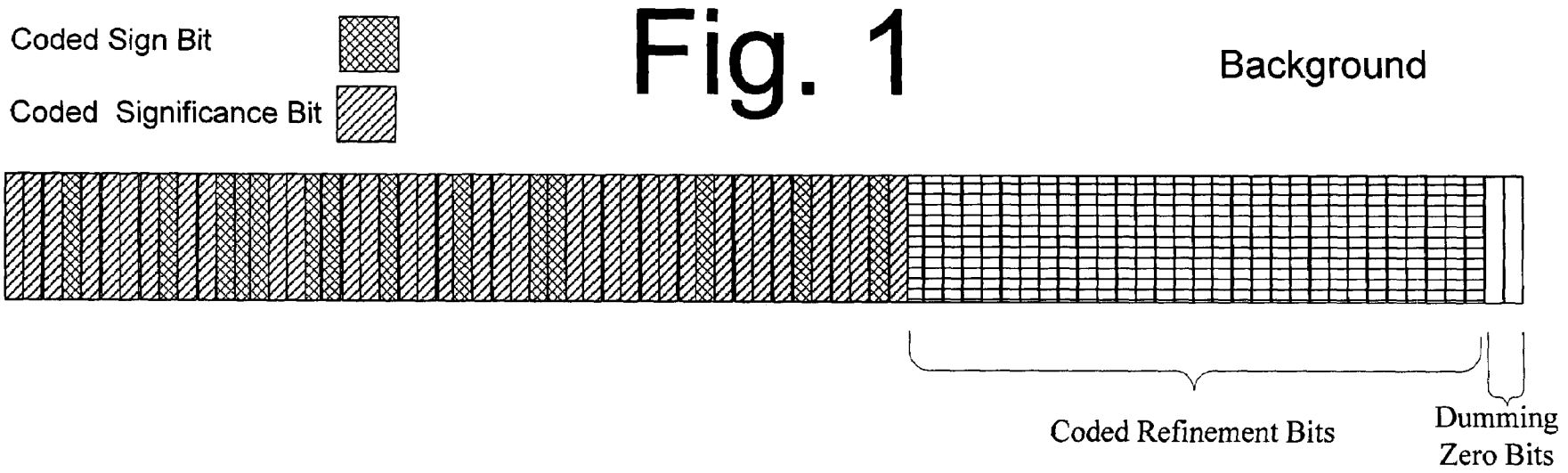
FIG. 1 is an overview for explaining a conventional scalable audio bitstream for one (1) data unit (DU) of one (1) coded bit-plane in any of a variety of information mediums, such as a recordable/reproducible compact disc (CD).

Whereas FIG. 1 showed an interleaving of coded refinement bits, coded sign bits, and coded significance bits in the syntax of one (1) data unit (DU) of one (1) coded bit-plane, FIG. 2 depicts the de-interleaving of the coded refinement bits, the coded sign bits, and the coded significance bits in the DU into independent partitions. The order of the partitions is, respectively, the coded refinement bits partition, the coded significance bits partition, an added partition containing a string of SBM bits, and the coded sign bits partition. The ordered independent partitions enable a decoder to locate and restrict any error in the DU to a particular partition. To locate errors among the partitions seen in FIG. 2, it is preferable that the decoder be able to identify a boundary for each of the partitions. This identification is made possible by placing the coded refinement bits into an independent first partition before the bits in the coded significance bits partition, the SBM bits partition, and the coded sign bits partition. In this way, the decoder can deduce the size of the refinement bits partition from the DUs in the previous layer. This resolves the ambiguity about the coded refinement bits partition of each DU. To accomplish the task, the SBM bits partition is added to distinguish the coded significance bits from the coded sign bits in each DU. Because the VLC used by the encoder has a finite code tree, the bit string in the SBM bits partition can be selected to be an invalid codeword. In addition, and for error robustness reasons, the bit string in the SBM bits partition can be selected so as to be sufficiently far in terms of Hamming distance from valid codewords so that the bit string in the SBM bits partition can be detected even if the SBM bits partition is corrupted.

The foregoing discussion is applicable to a scalable audio coding apparatus for coding audio signals. The apparatus includes a signal processor for signal-processing input audio signals, a quantizer, and an encoder. The quantizer quantizes the signal processed input audio signals into quantized data of weighted subbands. The encoder bit-plane codes the quantized data into an embedded audio bitstream of bit-planes. The embedded audio bitstream includes binary data having bits. Each bit-plane has a data unit that includes a beginning partition having one or more contiguous refinement bits, a second partition having one or more contiguous coded significance bits, a third partition having one or more contiguous sign boundary mark (SBM) bits, and a fourth partition having one or more contiguous coded sign bits. The third partition is between the second and fourth partitions. Each data unit can have a last partition filled with dummy zeros so as to assure that the data unit is byte-aligned.

The encoder can use a VLC algorithm having a finite code set. Preferably, the bit-plane coding of encoder will generate the third partition as an invalid codeword for the predetermined coding method. The invalid codeword generated by the predetermined coding method can be a significant Hamming distance from valid codewords of the predetermined coding method so that the SBM bits in the third partition can be detected even if it is corrupted.

An encoder of a codec can be used to code the audio bitstream using reversible variable length codes (RVLC). RVLC are special VLC that can be decoded instantaneously both in the forward and backward directions. When bit errors occur, the decoder can locate them by comparing the decoding results in the two different directions. Reversible exponential Golomb (Exp-Golomb) codes are a form of RVLC. As an extension of the Exp-Golomb codes, reversible Exp-Golomb codes have a length distribution identical to the Exp-Golomb codes. Therefore, they can increase the robustness of channel errors while suffering no loss in coding efficiency. The RVLC algorithm and Reversible Exp-Golomb codes, as described herein, can be used in different audio codecs.

Like Golomb codes, Exp-Golomb codes are associated with an order in a way of a small order for coding small entropy sources and a large order for large entropy sources. For binary bits, the optimal value of the order can be calculated by the probability of the occurrence of the zero bits. According to the order, each codeword includes a variable-length prefix part and a fixed-length suffix part. Exp-Golomb Codes are not sensitive to the value of the order and the range of the order is somewhat limited. Hence, the selection of a suitable order is not difficult. The value of the order is determined by the property of the coded significance bits in the DU after bit-plane coding. Preferably, the order will be set to one (1) in the first two bit-planes and will be set to two (2) in other bit-planes.

Reversible Exp-Golomb codes are applied to the coded significance bits in the ERSAC scheme. As mentioned in the previous subsection, the codewords have a finite code tree. Some nodes on the code tree are invalid and can be serves as "traps" to detect errors. Once the decoder encounters an invalid codeword, the decoder can then recognize that errors exist in the bitstream, although the decoder can not identify exact positions. Normally the received significance data are decoded both in the forward and backward directions. In case of an error, the decoder will locate the error from either the forward decoding pass or from the backward decoding pass.

It is preferable that the decoder be enabled with error handling capability, particularly for the suppression of propagating errors. Non-propagating errors have limited impairments to the whole bitstream and they are tolerable by the decoder. In contrast, the propagating errors can have significant impairments as to render the decoder inoperative (e.g. the decoder will crash). Hence, the propagating errors should be detected and located by the decoder. Errors in the sign and refinement bits are non-propagating. It is preferable that the decoder detect errors in the coded significance bits, which have preferably been coded with reversible Exp-Golomb codewords. Each reversible Exp-Golomb codeword includes a variable-length prefix and a fixed-length suffix. A bit error in the fixed-length suffix is non-propagating. Whether a bit error in the variable-length prefix is a propagating error or a non-propagating error depends on the specific location of the bit error. A bit error in an odd position in the variable-length prefix is a propagating error, while a bit error in an even position in the variable-length prefix is non-propagating error.

Since a propagating error can occur only in the coded significance bits, error handling is applied only to the coded significance bits. There is an upper limit on the coded run length of the coded significance bits. Once the length of a run exceeds the upper limit, it will be split into multiple runs for independent decoding. However, there is a tradeoff in terms of how to choose the upper limit. On one hand, it is not desirable to code long run lengths into one codeword. Once a codeword is corrupted by a bit error, it may incur a large error in subsequent decoding. In addition, it is important to have a finite code tree, which is necessary for the selection of the SBM bits partition and the RVLC. To allow more invalid codewords, the upper limit will preferably be relatively small so that a relatively small code tree can be obtained. In other words, it is more preferable to have a relatively small upper limit for error resilience. On the other hand, splitting the long run lengths may reduce the coding efficiency.

Due to the data partitioning in general and the SBM bits partition in particular, the boundary of the coded significance bits can be known in advance. RVLC can then be used to track and locate the errors. Normally the coded significance bits are decoded both in the forward and backward directions. When an error (e.g., an invalid codeword) is detected, the reversible Exp-Golomb decoder will stop and locate the error in either decoding direction. Furthermore, the scheme can be used to apply sanity checks on the decoded significance bits because the number of the coded significance bits is known before decoding and the number of binary ones ("1") in the coded significance bits must be identical to the number of sign bits. If no errors are detected in both the forward and backward decoding directions and the decoded data passes the sanity check, the decoding result will be understood to be correct. If an error occurs in decoding, the decoding results of both the forward and backward decoding directions will be compared and identical portions in the two decoding results will then be considered to be correct. By this means, the most potentially correct bits can be utilized in the subsequent source decoding stage.

The foregoing discussion is applicable to a scalable audio decoding apparatus. The decoding apparatus includes a decoder to decode and dequantize an embedded audio bitstream of bit-planes received from an encoder. The quantizing produces quantized data of weighted subbands. The decoding apparatus also includes an inverse quantizer to dequantize the quantized data of weighted subbands into audio signals. In addition, the decoder decodes the coded significance bits in the second partition of each DU using Reversible Exp-Golomb codewords that include a variable-length prefix part and a fixed-length suffix part. The decoder performs an error detection procedure upon the variable-length prefix of the coded significance bits in both forward and backward directions to detect an invalid codeword. Upon detection of an invalid codeword, the decoder identifies a location of the invalid codeword in the variable-length prefix of the coded significance bits. Once the invalid codeword has been identified and located, it is preferred that the decoder derive a result for an error detection in the forward direction with a result for an error detection in the backward direction. These two results are compared to determine identical portions of the variable-length prefix of the coded significance bits. The identical portions are then accepted by the decoder.

Better quality delivered audio can be achieved by ERSAC over conventional SAC in that audio is rendered such that pauses or artifacts tend to be imperceptible to common listeners.

General Network Structure

Figure 3:
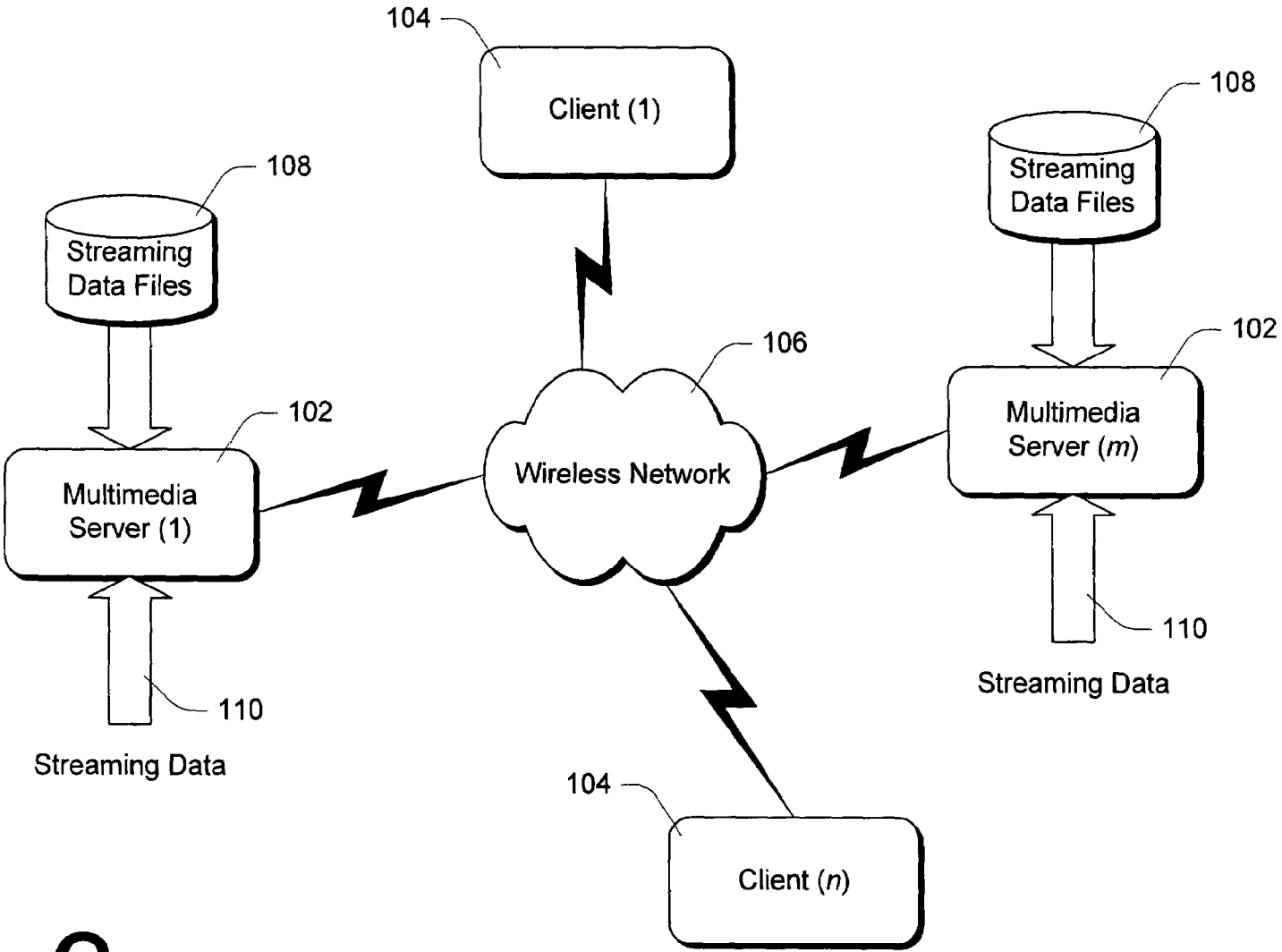
FIG. 3 is a block diagram, in accordance with an embodiment of the present invention, of a networked client/server system.

FIG. 3 shows a client/server network system and environment, in accordance with an embodiment of the present invention, for scalable audio streaming over wireless IP channels and networks. Generally, the system includes one or more (m) network server computers 102, and one or more (n) network client computers 104. The computers communicate with each other over a data communications network, which in FIG. 3 includes a wireless network 106. The data communications network might also include the Internet or local-area networks and private wide-area networks. Network server computers 102 and network client computers 104 communicate with one another via any of a wide variety of known protocols, such as the Transmission Control Protocol (TCP) or User Datagram Protocol (UDP).

Each of the m network server computers 102 and the n network client computers 104 can include an error resilient scalable audio codec for performing error resilient scalable audio coding (ERSAC) as discussed above. On the sender side, a raw audio signal is first put into the scalable audio encoder to form several quality layers. The error resilient source encoder is the first component to combat the transmission errors in the system. The scalable audio encoder performs data partitioning in the scalable audio bitstream. Data partitioning reorganizes the scalable audio bitstream so that errors can be detected and recovered more quickly. On the receiver side, the decoder of the codec performs RVLC using Reversible Exp-Golomb codes having a prefix property such that they can be uniquely decoded in the forward direction and also in the reverse direction. As such, the decoder can better isolate the location of errors for better data recovery.

Network server computers 102 have access to streaming media content in the form of different media streams. These media streams can be individual media streams (e.g., audio, video, graphical, etc.), or alternatively composite media streams including multiple such individual streams. Some media streams might be stored as files 108 in a database or other file storage system, while other media streams 110 might be supplied to the network server computer 102 on a "live" basis from other data source components through dedicated communications channels or through the Internet itself. The media streams received from network server computers 102 are rendered at the network client computers 104 as an audio presentation, which can include media streams from one or more of the network server computers 102. A user interface (UI) at the network client computer 104 can allows users various controls, such as allowing a user to either increase or decrease the speed at which the audio presentation is rendered.

Exemplary Computer Environment

In the discussion below, the invention will be described in the general context of computer-executable instructions, such as program modules, being executed by one or more conventional personal computers. Generally, program modules include routines, programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, mini-computers, mainframe computers, and the like. In a distributed computer environment, program modules may be located in both local and remote memory storage devices. Alternatively, the invention could be implemented in hardware or a combination of hardware, software, and/or firmware. For example, one or more application specific integrated circuits (ASICs) could be programmed to carry out the invention.

As shown in FIG. 3, a network system in accordance with the invention includes network server computer(s) 102 from which a plurality of media streams are available. In some cases, the media streams are actually stored by network server computer(s) 102. In other cases, network server computer(s) 102 obtain the media streams from other network sources or devices. The system also includes network client computer(s) 104. Generally, the network client computer(s) 104 are responsive to user input to request media streams corresponding to selected multimedia content. In response to a request for a media stream corresponding to multimedia content, network server computer(s) 102 streams the requested media streams to the network client computer 104, where the streams have a format in accordance with the data structure seen in FIG. 2. The network client computer 104 audio renders the data streams to produce an audio presentation.

Figure 4:
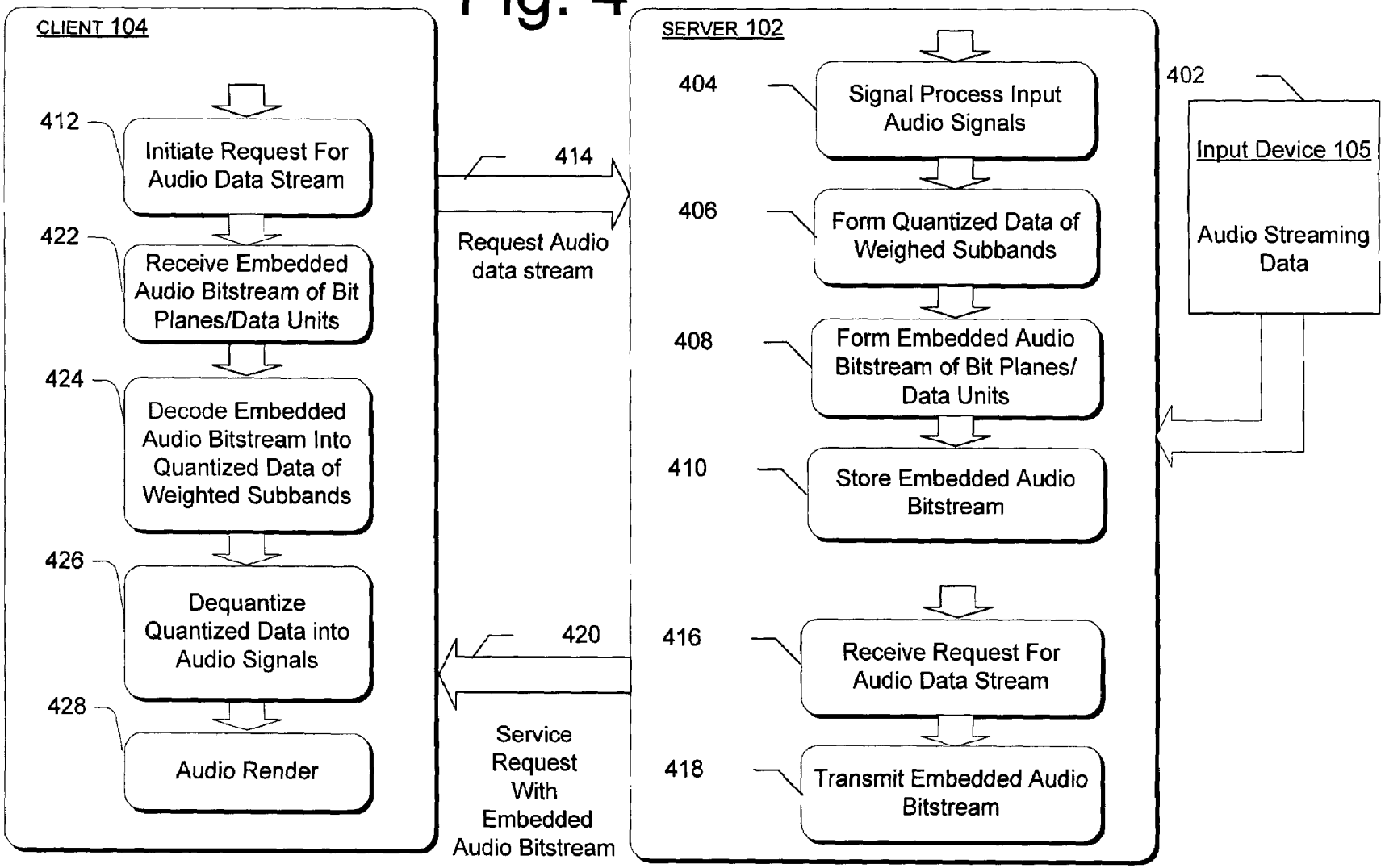
FIG. 4 is a block diagram, in accordance with an embodiment of the present invention, illustrating communications between a client and a server, where the server serves to the client a requested embedded audio bitstream that the client can decode and audio render.

FIG. 4 illustrates the input and storage of audio data on a server, as well communications between the server and a client in accordance with an embodiment of the present invention. By way of overview, the server receives input of an audio data stream. The server encodes the audio data stream using the encoder of the server's ERSAC codec. The ERSAC formatted data stream is then stored by the server. Subsequently, the client requests the corresponding audio data stream from the server. The server retrieves and transmits to the client the corresponding audio stream that the server had previously stored in the ERSAC format. The client decodes the ERSAC audio stream, which the client has received from the server, using the decoder of the client's ERSAC codec so as to perform audio rendering.

The flow of data is seen in FIG. 4 between and among blocks 402-428. At block 402, an input device 105 furnishes to network server computer 102 input that includes audio streaming data. By way of example, the audio streaming data might be supplied to network server computer 102 on a "live" basis by input device 105 through dedicated communications channels or through the Internet. The audio streaming data is supplied to a signal processor of network server computer 102 at block 404 for processing of audio signals. At block 406, quantized data of weighed subbands is formed from the processed input audio signals.

At block 408, an embedded audio bitstream is formed so as to include bit planes, where each bit plane has a data unit such as is seen in FIG. 2. The embedded audio bitstream so constructed is then stored at block 410, such as in streaming data files 108 seen in FIG. 3.

Network client computer 104 makes a request for an audio data stream at block 412 that is transmitted to server 102 as seen at arrow 414 in FIG. 4. At block 416, server 102 receives the request and transmits a corresponding embedded audio bitstream as seen in blocks 418-420. The embedded audio bitstream is received by network client computer 104 at block 422. At block 424, the network client computer 104 employs a decoder to decode the embedded audio bitstream into quantized data of weighted subbands. Preferably, the decoding will be performed using reversible Exp-Golomb codes as discussed above. At block 426, the decoder dequantizes the quantized data into audio signals. At block 428, the decoder audio renders the decompressed audio signals.

Figure 5:
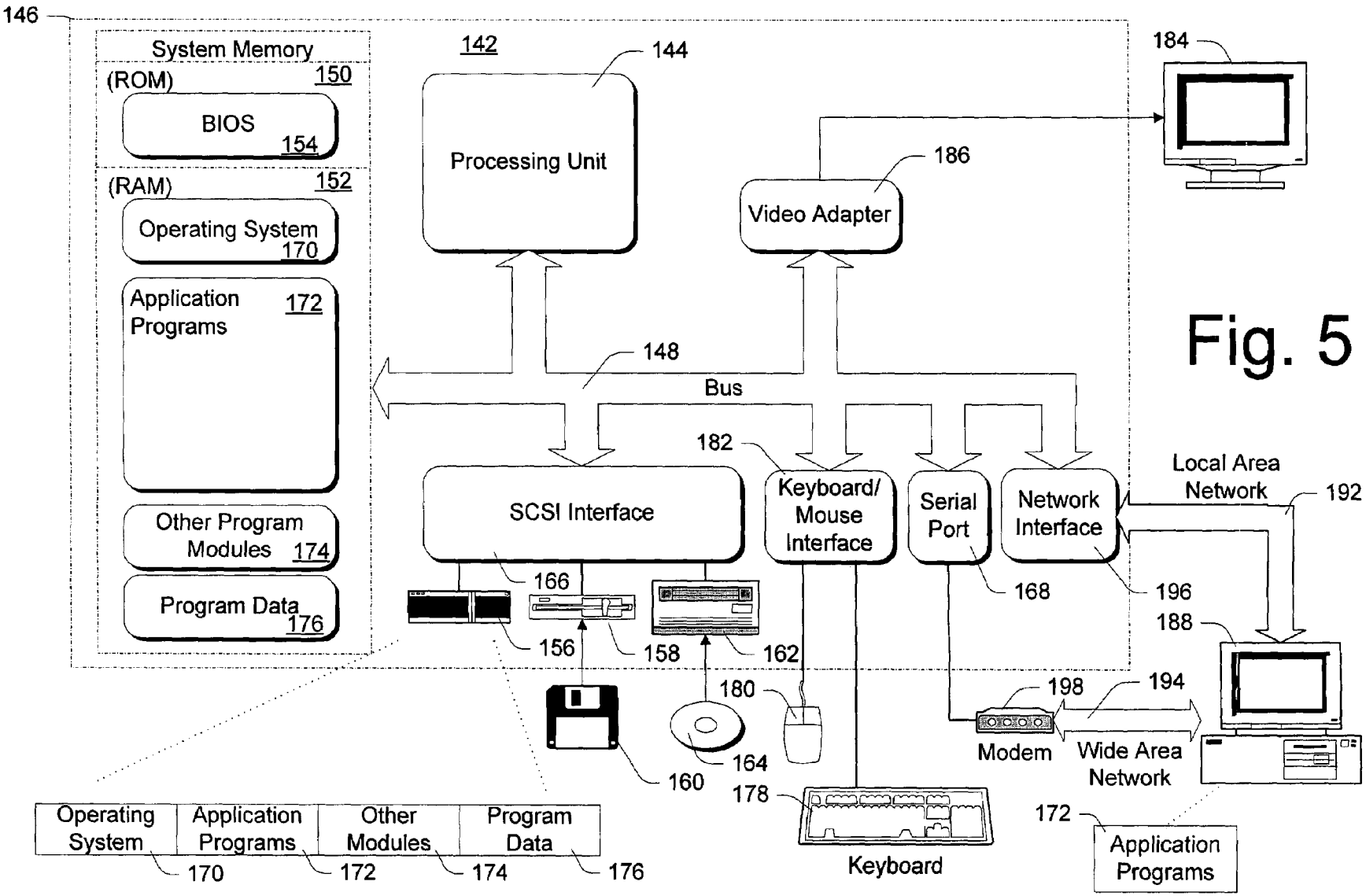
FIG. 5 is a block diagram, in accordance with an embodiment of the present invention, of a networked computer that can be used to implement either a server or a client.

FIG. 5 shows a general example of a computer 142 that can be used in accordance with the invention. Computer 142 is shown as an example of a computer that can perform the functions of any of network client computers 104 or network server computers 102 of FIG. 3. Computer 142 includes one or more processors or processing units 144, a system memory 146, and a system bus 148 that couples various system components including the system memory 146 to processors 144.

The bus 148 represents one or more of any of several types of bus structures, including a memory bus or memory controller, a peripheral bus, an accelerated graphics port, and a processor or local bus using any of a variety of bus architectures. The system memory includes read only memory (ROM) 150 and random access memory (RAM) 152. A basic input/output system (BIOS) 154, containing the basic routines that help to transfer information between elements within computer 142, such as during start-up, is stored in ROM 150. Computer 142 further includes a hard disk drive 156 for reading from and writing to a hard disk (not shown), a magnetic disk drive 158 for reading from and writing to a removable magnetic disk 160, and an optical disk drive 162 for reading from or writing to a removable optical disk 164 such as a CD-RW, a CD-R, a CD ROM, or other optical media.

Any of the hard disk (not shown), magnetic disk drive 158, optical disk drive 162, or removable optical disk 164 can be an information medium having recorded information thereon. The information medium has a data area for recording stream data, such as a scalable audio bitstream having one data unit of one coded bit-plane as seen in FIG. 2. By way of example, each data unit can be encoded and decoded by an ERSAC codec executing in processing unit 144, as describe above. As such, the encoder distributes the stream data so that the distributed stream data can be recorded using an encoding algorithm, such as is used by an ERSAC encoder.

The hard disk drive 156, magnetic disk drive 158, and optical disk drive 162 are connected to the system bus 148 by an SCSI interface 166 or some other appropriate interface. The drives and their associated computer-readable media provide nonvolatile storage of computer readable instructions, data structures, program modules and other data for computer 142. Although the exemplary environment described herein employs a hard disk, a removable magnetic disk 160 and a removable optical disk 164, it should be appreciated by those skilled in the art that other types of computer readable media which can store data that is accessible by a computer, such as magnetic cassettes, flash memory cards, digital video disks, random access memories (RAMs), read only memories (ROM), and the like, may also be used in the exemplary operating environment.

A number of program modules may be stored on the hard disk, magnetic disk 160, optical disk 164, ROM 150, or RAM 152, including an operating system 170, one or more application programs 172, other program modules 174, and program data 176. A user may enter commands and information into computer 142 through input devices such as keyboard 178 and pointing device 180. Other input devices (not shown) may include a microphone, joystick, game pad, satellite dish, scanner, or the like. These and other input devices are connected to the processing unit 144 through an interface 182 that is coupled to the system bus 148. A monitor 184 or other type of display device is also connected to the system bus 148 via an interface, such as a video adapter 186. In addition to the monitor 184, personal computers typically include other peripheral output devices (not shown) such as speakers and printers.

Computer 142 operates in a networked environment using logical connections to one or more remote computers, such as a remote computer 188. The remote computer 188 may be another personal computer, a server, a router, a network PC, a peer device or other common network node, and typically includes many or all of the elements described above relative to computer 142. The logical connections depicted in FIG. 5 include a local area network (LAN) 192 and a wide area network (WAN) 194. Such networking environments are commonplace in offices, enterprise-wide computer networks, intranets, and the Internet. In the described embodiment of the invention, remote computer 188 executes an Internet Web browser program such as the Internet Explorer ® Web browser manufactured and distributed by Microsoft Corporation of Redmond, Wash.

When used in a LAN networking environment, computer 142 is connected to the local network 192 through a network interface or adapter 196. When used in a WAN networking environment, computer 142 typically includes a modem 198 or other means for establishing communications over the wide area network 194, such as the Internet. The modem 198, which may be internal or external, is connected to the system bus 148 via a serial port interface 168. In a networked environment, program modules depicted relative to the personal computer 142, or portions thereof, may be stored in the remote memory storage device. It will be appreciated that the network connections shown are exemplary and other means of establishing a communications link between the computers may be used.

Generally, the data processors of computer 142 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described above in conjunction with a microprocessor or other data processor. The invention also includes the computer itself when programmed according to the methods and techniques described above. Furthermore, certain sub-components of the computer may be programmed to perform the functions and steps described above. The invention includes such sub-components when they are programmed as above. In addition, the invention described herein includes data structures, described below, as embodied on various types of memory media.

For purposes of illustration, programs and other executable program components such as the operating system are illustrated herein as discrete blocks, although it is recognized that such programs and components reside at various times in different storage components of the computer, and are executed by the data processor(s) of the computer.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A scalable audio coding apparatus comprising:

a signal processor configured to signal-process input audio signals;

a quantizer configured to quantize the signal processed input audio signals into quantized data of weighted subbands; and an encoder configured to bit-plane code the quantized data into an embedded audio bitstream of bit-planes, wherein each said bit-plane has at least one data unit that comprises one or more partitions for facilitating determination of one or more errors in the data unit, wherein the embedded audio bitstream comprises binary data having bits, and wherein the one or more partitions comprise at least one partition having one or more contiguous sign boundary mark bits for facilitating determination of at least one of the errors.

2. The apparatus of claim 1, wherein each said data unit further comprises one or more refinement bits, one or more coded significance bits, and one or more coded sign bits.

3. The apparatus of claim 2, wherein one or more refinement bits, one or more coded significance bits, and one or more coded sign bits are independently partitioned.

4. The apparatus of claim 3, wherein the partition having one or more contiguous sign boundary mark bits is located in between the partition having one or more coded significance bits and the partition having one or more coded sign bits.

5. The apparatus of claim 1, wherein:

the quantizer is configured to quantize using a variable length coding algorithm having a finite code; and the encoder is configured to execute a predetermined coding method, wherein the predetermined coding method is configured to generate the partition having one or more contiguous sign boundary mark bits as an invalid codeword for the predetermined coding method.

6. The apparatus of claim 5, wherein the invalid codeword has a significant Hamming distance from valid codewords of the predetermined coding method.

7. A scalable audio coding apparatus comprising:

a signal processor configured to signal-process input audio signals;

a quantizer configured to quantize the signal processed input audio signals into quantized data of weighted subbands; and an encoder configured to bit-plane code the quantized data into an embedded audio bitstream of bit-planes, wherein each said bit-plane has at least one data unit that comprises one or more partitions for facilitating determination of one or more errors in the data unit, wherein each said data unit further comprises a partition having dummy zeros, whereby the data unit is byte-aligned.

8. A scalable audio decoding apparatus comprising:

a decoder configured to decode an embedded audio bitstream of bit-planes into quantized data of weighted subbands, wherein the embedded audio bitstream comprises binary data having bits of differing types, and wherein each said bit-plane has at least one data unit that comprises one or more partitions for facilitating determination of one or more errors in the data unit, the partitions comprising multiple contiguous bits of a same type; and an inverse quantizer configured to dequantize the quantized data of weighted subbands into audio signals, wherein the one or more partitions comprises at least one partition having one or more sign boundary mark bits for facilitating determination of at least one of the errors.

9. The apparatus of claim 8, wherein each said data unit further comprises one or more refinement bits, one or more coded significance bits, and one or more coded sign bits.

10. The apparatus of claim 9, wherein one or more refinement bits, one or more coded significance bits, and one or more coded sign bits are independently partitioned.

11. The apparatus of claim 10, wherein the partition of one or more sign boundary mark bits is located in between the partition of one or more coded significance bits and the partition of one or more coded sign bits.

12. The apparatus of claim 8, wherein each said data unit further comprises a partition having dummy zeros, whereby the data unit is byte-aligned.

13. The apparatus of claim 8, wherein the decoder is configured to decode using Reversible exponential Golomb (Exp-Golomb) codewords in a Reversible Variable Length Code (RVLC) algorithm.

14. The apparatus of claim 13, wherein the one more partitions comprises a partition having one or more coded significance bits, and wherein the decoder is configured to:

decode each said partition having one or more coded significance bits using Reversible Exp-Golomb codewords that comprise a variable-length prefix part and a fixed-length suffix part;

perform error detection in the variable-length prefix of the coded significance bits in both forward and backward directions to detect an invalid codeword; and identify a location of the invalid codeword upon detection.

15. The apparatus of claim 14, wherein the one more partitions comprises a partition having one or more coded significance bits, and wherein, upon identification of the location of the invalid codeword, the decoder is configured to:

compare a result of the error detection in the forward direction with a result of the error detection in the backward direction; and accept, for the decoding of the partition having one or more coded significance bits, identical portions of the variable-length prefix of the coded significance bits as determined by the results of the error detection in the forward and backward directions.

* * * * *